US005352376A

United States Patent [19]

Gutzmann

[11] Patent Number: 5,352,376

[45] Date of Patent: Oct. 4, 1994

[54] THERMOPLASTIC COMPATIBLE CONVEYOR LUBRICANT

[75] Inventor: Timothy A. Gutzmann, Eagan, Minn.

[73] Assignee: Ecolab Inc., St. Paul, Minn.

[21] Appl. No.: 19,606

[22] Filed: Feb. 19, 1993

[51] Int. Cl.[5] ..... C01M 173/02; C01M 101/02

[52] U.S. Cl. ..... 252/49.3; 252/50; 252/52 R; 252/56 R

[58] Field of Search ..... 252/49.3, 50, 52 R:56 R

[56] References Cited

U.S. PATENT DOCUMENTS

| | | | |
|---|---|---|---|
| Re. 30,885 | 3/1982 | Rieder | 252/34 |
| Re. 33,032 | 8/1989 | Binsack et al. | 524/165 |
| 2,990,943 | 7/1961 | Turinsky | 205/2 |
| 3,051,655 | 8/1962 | Barker | 252/49.9 |
| 3,350,346 | 10/1967 | Maxson | 260/45.7 |
| 3,352,787 | 11/1967 | Bodach et al. | 252/108 |
| 3,718,588 | 2/1973 | Bellos et al. | 252/32.5 |
| 3,860,521 | 1/1975 | Aepli et al. | 252/34.7 |
| 3,950,258 | 4/1976 | Imai et al. | 252/33 |
| 4,214,062 | 7/1980 | Binsack et al. | 525/470 |
| 4,328,108 | 5/1982 | Deeken | 252/8.6 |
| 4,419,251 | 12/1983 | Shim et al. | 252/32.7 E |
| 4,521,321 | 6/1985 | Anderson et al. | 252/49.3 |
| 4,529,761 | 7/1985 | Lohmeijer | 524/157 |
| 4,536,318 | 8/1985 | Cook et al. | 252/174.17 |
| 4,604,220 | 8/1986 | Stanton | 252/33.4 |
| 4,680,329 | 7/1987 | Brown et al. | 524/143 |
| 4,683,074 | 7/1987 | Malik et al. | 252/136 |
| 4,769,162 | 9/1988 | Remus | 252/18 |
| 4,834,903 | 5/1989 | Roth et al. | 252/174.17 |
| 4,839,067 | 6/1989 | Jansen | 252/11 |
| 4,863,633 | 9/1989 | Colborn et al. | 252/187.26 |
| 4,919,845 | 4/1990 | Vogt et al. | 252/526 |
| 4,929,375 | 5/1990 | Rossio et al. | 252/49.3 |
| 5,001,114 | 3/1991 | McDaniel, Jr. | 514/25 |
| 5,003,057 | 3/1991 | McCurry et al. | 536/186 |
| 5,009,801 | 4/1991 | Wider et al. | 252/33.2 |
| 5,062,978 | 11/1991 | Weber et al. | 252/49.3 |
| 5,073,280 | 12/1991 | Rossio et al. | 252/49.3 |
| 5,076,953 | 12/1991 | Jordan et al. | 252/108 |
| 5,104,585 | 4/1992 | Fabry et al. | 252/555 |

FOREIGN PATENT DOCUMENTS

0432836A2 6/1991 European Pat. Off. .

OTHER PUBLICATIONS

Dairy Insight, *Conveyor Lubrication in Dairies, Breweries and Beverage Plants,* by Peter Gilbert, Klensan (Pty) Ltd., Dec. 1981./Jan. 1982, pp. 27–28.

*Primary Examiner*—Asok Pal
*Assistant Examiner*—P. Achutamurthy
*Attorney, Agent, or Firm*—Merchant, Gould, Smith, Edell, Welter & Schmidt

[57] ABSTRACT

A thermoplastic compatible lubricant concentrate containing alkylpolyglycoside suitable for use in lubricating conveyor belts in the transporting of thermoplastic article of manufacture. The hydrophobic group of the alkylpolyglycoside is a long chain alkyl group having 5 to 30 carbon atoms. The degree of polymerization of the saccharide units in the polyglycoside is less than 3.

30 Claims, 2 Drawing Sheets

THERMOPLASTIC COMPATIBLE CONVEYOR LUBRICANT

FIELD OF THE INVENTION

The invention relates to aqueous lubricants. More particularly, the invention relates to a conveyor lubricant that reduces stress cracking in thermoplastic containers being transported in food processing plants.

BACKGROUND OF THE INVENTION

In the food processing, in particular, the beverage industry, the cleaning, filling and labeling, etc. of bottles are carried out automatically. The bottles are moved from operation station to operation station on belt conveyors. In order to keep the conveyor chains cleaned and provide lubrication, aqueous based lubricants are used. Generally, these lubricants are manufactured as concentrates and are diluted, for example, in 1 to 100, or 1 to 1000 with water at the point of use. Some of these lubricants are soap-based as is disclosed by Aepli et al., U.S. Pat. No. 3,860,521. A disadvantage of these lubricating agents is that soaps are sensitive to water hardness. Sequestering agents such as ethylenediamine tetraacetic acid (EDTA) are added to partially mask the hardness. Hardness, usually associated with magnesium and calcium ions, tend to reduce the effectiveness of the lubricating agent. These hardness ions tend to precipitate salts leading to lubricating problems.

Synthetic amine-based lubricating agents are also known. While these amine-based lubricating agents do not have the problems associated with the soap-based lubricants, they tend to react with ions such as carbonates and sulfates which are present in water, thus reducing the lubricating effect. Furthermore, some amines together with other ingredients and constituents such as alcohol that are present in lubricants can have a deleterious effect on thermoplastics such as polyethylene terephthalate (PET), polybutylene terephthalate (PBT), polysulfone and polycarbonate. At the present, thermoplastics are widely used in the beverage industry due to their availability, inexpensive nature, and their unique plastic properties.

Many different formulations of lubricants have been disclosed in the past. The aforementioned Aepli et al. U.S. Pat. No. 3,860,521 disclose an aqueous lubricating concentrate for lubricating continuously moving conveyor system. This concentrate contains a fatty acid soap and a surfactant. The improvement comprises the addition to the lubricating composition of monostearyl acid phosphate.

Anderson et al., U.S. Pat. No. 4,521,321 disclose a lubricant concentrate comprising a partially neutralized monophosphate ester having a saturated or partially unsaturated linear alkyl group of $C_{12}$ to $C_{20}$, and the use of synergistic ingredients such as a long chain alcohol and fatty derived amine oxide to improve the properties of the lubricant compositions.

Stanton, U.S. Pat. No. 4,604,220 discloses a conveyor cleaner-lubricant concentrate derived from a concentrate of $C_{12}$ to $C_{18}$ alpha olefin sulfonate, and water or a water soluble solvent. The sulfonate concentrate can be directly diluted with water to form a cleaner lubricant or it can be directly added to soap lubricants.

Jansen, U.S. Pat. No. 4,839,067 discloses a process for the maintenance of chain type bottle conveyor belts in beverage plant wherein the bottle conveyor belts are lubricated with lubricating agents with a base of neutralized primary fatty amines and are cleaned with cationic cleaning agents or organic acids.

Weber et al., U.S. Pat. No. 5,062,978 disclose an aqueous lubricant solution consisting essentially of fatty alkyl amines which contains a saturated or unsaturated, branched or linear alkyl group having 8 to 22 carbon atoms.

It has long been known in the industry by the people skilled in the art that lubricants lead to a phenomenon which is commonly called "stress cracking." That is particularly prevalent in PET, polysulfone, polycarbonate containers and the like. A number of conventional aqueous based lubricants which contain alcohol and/or amines tend to promote stress cracking. Wider et al., U.S. Pat. No. 5,009,801 allegedly disclose a method for reducing stress cracking in polyalkylene terephthalate articles by using a stress cracking inhibitor which comprises a hydrophilic-substituted aromatic hydrocarbon having either an alkyl or an aryl side chain. Rossio et al., U.S. Pat. No. 5,073,280 allegedly disclose an aqueous fatty acid based lubricant comprising a stress crack inhibitor which is an alkylamine with at least 6 carbon atoms.

Alkylpolyglycosides, or alkyl substituted polyglycoside, are naturally derived nonionic surfactants. Generally, they are mild, moderately foaming, and highly soluble. An alkylpolyglycoside is a surfactant that contains a carbohydrate hydrophile with multiple hydroxyl groups, and are soluble in high levels of acids, bases, and electrolytes. Typically, they are non-gelling and insensitive to temperature change. Their unique physical, chemical and ecological properties make alkylpolyglycosides very attractive for formulating household and industrial cleaning applications such as hand and dishwashing and laundry detergents.

Cook et al., U.S. Pat. No. 4,536,318 discuss a foaming composition containing an alkyl polysaccharide surfactant and a co-surfactant mixture consisting essentially on an alkyl benzene sulfonate, wherein the saccharide moiety is derived from a reducing saccharide containing from 5 to 6 carbon atoms such as glucose, galactose, grucosyl, or grucosyl residue and the hydrophobic group is selected from the group consisting of alkyl, alkyl phenyl, hydroxyl alkyl phenyl or hydroxy alkyl group.

Roth et al., U.S. Pat. No. 4,834,903 describe the use of alkaline oxide adducts of relatively low degree of polymerization long chain glycoside composition composed of long chain monoglycoside species wherein the hydrophobic group contains 6 to 20 carbon atoms and the reducing saccharide contains 5 to 6 carbon atoms.

Vogt et al., U.S. Pat. No. 4,919,845 discuss a detergent composition containing nonionic surfactants including alkylglycosides and alkylpolyglycosides wherein the alkyl group contains 8 to 18 and preferably 10 to 16 carbon atoms.

McDaniel, U.S. Pat. No. 5,001,114 relates the use of new alkyl mono and polyglycoside phosphate esters and anionic derivatives thereof wherein the glycosyl moiety is selected from the group consisting of fructose, lactose, mannose, galactose, talose, gulose, allose, altrose, idose, arabinose, xylose, lyxose, and ribose, and the hydrophobic group is an aliphatic or aromatic hydrocarbon group.

McCurry et al., U.S. Pat. No. 5,003,057 disclose a process for the preparation of glycosides. The process comprises reacting in the presence of an acid catalyst an alcohol with a source of saccharide moiety, wherein the acid catalyst comprises a strong hydrophobic organic acid.

Jordan et al., U.S. Pat. No. 5,076,593 disclose a mild skin cleansing bar composition comprising alkylglycosides.

Fabry et al., U.S. Pat. No. 5,014,585 describe a detergent mixture containing at least one alkylglycoside having an aliphatic radical containing at least 8 carbon atoms, preferably a primary alcohol radical, and a glucose unit derived from a reducing saccharide containing 5 or 6 carbon atoms.

None of the aforementioned patents discloses the use of alkylpolyglycosides in aqueous lubricant solutions that prevents or reduces stress cracking in thermoplastic containers. There is one reference, van de Brom et al., European Patent Application No. 90203211.9, that describes the application of alkylpolyglycosides in a composition of plastics compatible detergents and rinse aids.

However, we are not aware of any patent or publication that teaches the use of alkylpolyglycosides in a conveyor belt lubricating composition.

Typically, conveyor lubricants that are compatible with PET, PBT or polybutylene terephthalate, polycarbonate and polysulfone and the like are not very effective as detergents or cleaning agents. Preferably a lubricant would contain ingredients that would provide detergency or cleaning properties so that the lubricants can also promote cleanliness. There is a need for lubricants having detergency property that are compatible with thermoplastics such as PET, PBT, polysulfone, polycarbonate and the like. Furthermore, because of the present concern for environmental compatibility and toxicity of chemicals used in food processing industry, there is a need for lubricants that contain ingredients that are biodegradable, nontoxic and derived from renewable resources.

SUMMARY OF THE INVENTION

In one aspect, the invention is a thermoplastic compatible lubricant concentrate containing an alkylpolyglycoside comprising a fatty ether derivative of a mono-, di-, tri-, etc. saccharide. The alkylpolyglycoside compares to the general formula $$G_x—O—R \qquad \text{I}$$

where G is a moiety derived from a reducing saccharide contain 5 or 6 carbon atoms; R is saturated or nonsaturated fatty alkyl group containing 5 to 30 carbon atoms; x is the number of monosaccharide repeating units in the polyglycoside, having a value of one to three. On a molecular basis, x is an integer. In products commonly obtained in laboratories and manufacturing facilities, the polyglycosides are mixtures, and x is an average number, and thus is generally a noninteger. In the invention, x is preferably between 1 and 2. Also, preferably G is a glucose moiety, and R is a saturated fatty alkyl group with between 6 to 20 carbon atoms. The alkylpolyglycosides are typically made by uniting a fatty alcohol with a commodity sugar such as glucose, fructose, and other polysaccharides derived from starch in corn products.

In another aspect, the invention is a lubricating composition comprising the aforementioned alkylpolyglycoside. In a preferred embodiment, the lubricating composition may comprise other adducts for improving the stability or improving the efficacy of the lubricant. The lubricant may contain other surfactants. These cosurfactants may be cationic, nonionic, or anionic.

One of the active ingredients added may be a fatty acid. A preferable fatty acid is one with saturated or unsaturated alkyl group containing between 8 to 22 carbon atoms. If a fatty acid is added, a neutralizer such as an alkali or an amine may be used to neutralize the fatty acid. The preferred alkali is potassium hydroxide. The preferred amine is a fatty alkyl substituted amine wherein the first substitute group of the amine is a saturated or unsaturated, branched or linear alkyl group having between 8 to 22 carbon atoms, and the second substitute group of the amine is a hydrogen, alkyl group or hydroxyalkyl group having 1 to 4 carbons, or an alkoxylate group, and the third substitute group of the amine is an alkylene group of 2 to 12 carbons bonded to a hydrophilic moiety such as $—NH_2$, —OH, $—SO_3$, amine alkoxylate, alkoxylate, and the like.

Another surfactant that can be used as cosurfactant is an alkoxylated alkylglycoside (also called oxyalkylated long chain glycoside) which comprises fatty ether derivative of a mono-, di-, tri-, etc. saccharide having an alkylene oxide residue. The alkoxylated alkylglycoside compares with the general formula $$H—(AO)_m—G_y—O—R \qquad \text{II}$$

where AO is an alkylene oxide residue, m is the degree of alkyl oxide substitution having an average of from 1 to about 30, G is a moiety derived from a reducing saccharide contain 5 of 6 carbon atoms, R is saturated or nonsaturated fatty alkyl group containing 6 to 20 carbon atoms, and y is the degree of polymerization, preferably smaller than 3.

Additionally, there may be stabilizers, also known as couplers or solubilizers to prevent some of the ingredients of the lubricant concentrate from phase separating. Sequestrants may also be added to improve the effectiveness of the surfactants and prevent hardness ions from precipitating out of solution.

Although the lubricant concentrate can be a substantially solid material, a water soluble solvent is generally used in the lubricant concentrate as a carrier of the ingredients. The preferred carrier is water.

Typically the lubricant concentrate is diluted with water in a concentrate/water ratio of 1:100 to 1:1000 before using. In another aspect of the invention, a method of lubricating a continuously-moving conveyor system for transporting a container is practiced by applying an diluted aqueous thermoplastic compatible lubricating composition to the exterior surface of the container. This application may be by means of spraying, immersing, brushing and the like. The dilution may be done batchwise or online using injection of a stream of concentrate into a stream of water.

In a preferred embodiment, a lubricant concentrate comprises: from about 1% to about 20% by weight of the alkylpolyglycoside; from about 2% to about 50% by weight of the fatty acid; from about 1% to about 25% by weight of the stabilizer for facilitating the prevention of phase separation; from about 0.5% to about 30% by weight of the neutralizing agent; and from about 2% to about 96% by weight of water.

In a preferred embodiment of a diluted aqueous lubrication composition, the composition comprises: from about 10 parts per million (ppm) to about 2000 ppm by weight of the alkylpolyglycoside; from about 20 ppm to about 5,000 ppm by weight of the fatty acid; from about 10 ppm to about 2,500 ppm by weight of the stabilizer for facilitating the prevention of phase separation; from about 5 ppm to about 3,000 ppm by weight of the neutralizing agent; and from about 90% to about 99.99% by weight of water.

DETAILED DESCRIPTION OF THE INVENTION

Figure 1:
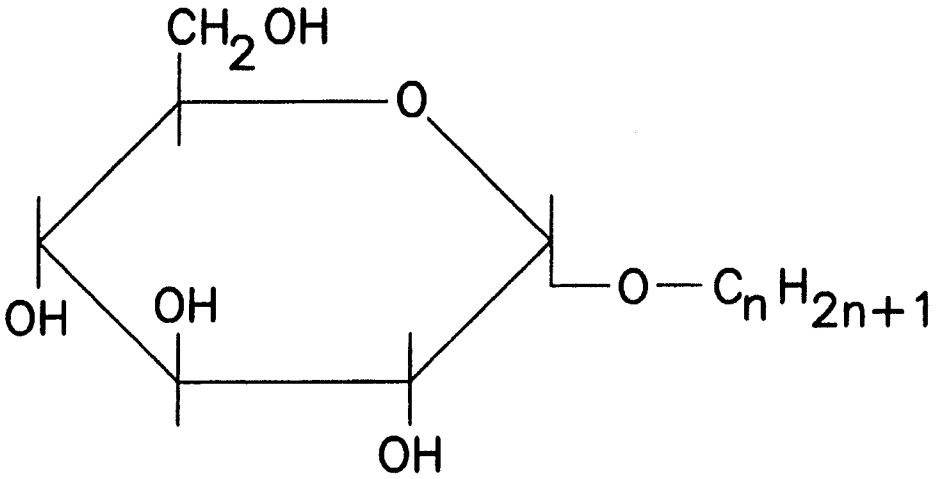
FIG. 1 shows the molecular structure of a typical alkylpolyglycoside wherein the saccharide is glucose.

In the food processing industry, food containers, which are often made of thermoplastic material, are transported from one location to another location by belt conveyors. Occasionally, the containers would be stopped in a certain location as in the case of filling or capping of the container. While the container is stopped, the belt is moved continuously. To facilitate the transportation of the containers, a lubricating composition is sprayed onto the surface of conveyor belt. The lubricating composition is typically an aqueous solution obtained by diluting a lubricant concentrate with water in a ratio varying from 1:100 to 1:1000.

One of the reason for the lubricating composition is to facilitate movement and reduce the damage to the container resulting from mechanical impact between the containers and the rubbing action among the containers and between the containers and the belt.

Accordingly, it is desirable that the lubricating composition has good surfactant property so that the solution would spread evenly over the surfaces of the belt and the containers, reduce the coefficient of friction between the surfaces, and further have good detergency characteristics to facilitate cleanliness. A desirable characteristic of the lubricating composition is thermoplastic compatibility. A lubricant is considered thermoplastic compatible if in its use, it passes compatibility tests established for the resins.

Other desirable characteristics of the lubricating composition are biodegradability and nontoxicity. The public is increasingly aware of the ecological problems caused by the release of man-made chemicals in the environment. More stringent governmental regulations are being implemented to respond to this public concern. Preferably, the lubricating composition would contain chemicals that are more biodegradable and less toxic than conventional chemicals used in lubricant concentrates.

The invention is a thermoplastic compatible lubricant concentrate that can be admixed with water to form a lubricant for facilitating the transportation of thermoplastic containers on a conveyor. In particular, the invention comprises an alkylpolyglycoside.

Alkylpolyglycosides (APGs), also called alkylpolyglucosides if the saccharide moiety is consisted of glucose, are naturally derived nonionic surfactants. APGs are commonly found in many household industrial and agricultural applications. Generally, they are mild, moderately foaming, and highly soluble. Alkylpolyglycosides are classified as nonionic surface active agents (or surfactants). Surfactants are compounds that modify, typically reduce the surface tension when in aqueous solution. A surfactant is called nonionic when there is no electrical charge when in the solution. Typically, commercially available nonionic surfactants are based on petrochemical feed stocks. They are usually composed of a variety of ethoxylated linear alcohols (LAE) and ethoxylated phenols of various chain lengths. The solubility of alkylpolyglycosides is insensitive to temperature, thereby exhibiting no cloud point and they are extremely tolerant to high electrolyte concentrations with no phase separation or precipitation. Alkylpolyglycosides also are stable over a pH range. Alkylpolyglycosides exhibit similar formulation properties such as surface tension reduction and wetting time. Alkylpolyglycosides unlike typically known ionic surfactants which are very foaming, are only moderately foaming. Because of the carbohydrate property and the excellent solubility characteristics, alkylpolyglycosides are compatible in high caustic and builder formulations. Even under high alkaline conditions, alkylpolyglycosides continue to reduce surface tension. Alkylpolyglycosides are also compatible with a wide range of acids.

Alkylpolyglycosides also been found to exhibit low oral and dermal toxicity and irritation on the mammalian tissues. Alkylpolyglycosides are also completely biodegradable in both anaerobic and aerobic environments and they exhibit low toxicity to plants.

Alkylpolyglycosides contain a carbohydrate hydrophile with multiple hydroxyl groups. Because of their unique solubility properties and their naturally derived nature, alkylpolyglycosides are very attractive for formulating applications requiring surfactants. They are good alternatives to petroleum-based chemicals. Quite often, when combined with an anionic, nonionic, and cationic surfactants, they provide synergistic surface active performance. Furthermore, if the hydrophobic portion of the molecule of alkylpolyglycoside is also derived from natural plant or animal-based feed stocks, the entire polyglycoside surfactant is made from renewable resources. With the present concern on environmental safety, their acceptable toxicity and biodegradability together with the broad range application versatility, makes alkylpolyglycoside surfactants an attractive material for the chemical industry. Presently alkylpolyglycosides are used in detergent and industrial markets.

Polyglycosides have found use in shampoos, bath products and cleaners, detergents, metal cleaning treating, bottle washing, fire fighting foams, paper manufacturing and transportation cleaners. Alkylpolyglycosides also have been used in agricultural formulations as adjuvants to improve the effectiveness of herbicides, insecticides and fungicides. Alkylpolyglycosides have also been known to improve the substantivity of quaternary ammonium compounds, therefore improving the softening efficacy on synthetic fabrics such as dacron (PET).

Alkylpolyglycosides are usually derived from corn-based carbohydrates and fatty alcohols from natural oils in animals, coconuts and palm kernels. Of course, if a nonglucose sugar is the monomer of the glycoside, a noncorn-based carbohydrate would be used as the feed stock. It is also possible to derive the fatty alcohols from ethylene. Alkylpolyglycosides are formed when a carbohydrate is reacted under acid condition with a fatty acid through condensation polymerization. At room temperature, polyglycosides are solid, high temperature melting, hygroscopic polymers. Commercially, alkylpolyglycosides are provided as aqueous solutions ranging from 50 to 70 wt-% active. Example of a commercial suppliers of alkylpolyglycosides are Henkel and Union Carbide.

A polyglycoside molecule contains a hydrophilic group derived from carbohydrates and is composed of one or more reducing saccharides, typically, anhydroglucose. Each of the saccharide units has two ether oxygens and hydroxy groups. Hydrogen bonding interactions with these hydroxyl groups results in water solubility. The presence of the alkyl carbon and hydrogen chain leads to the hydrophobic activity. The long carbon (or alkyl) chain and saccharide derivatives of various degree of polymerization are the reason of the name alkylpolyglycoside. When carbohydrate molecules react with fatty alcohol molecules, alkylpolyglycosides molecules are formed with single or multiple saccharide units, which are termed monoglycosides and polyglycosides, respectively. The final alkylpolyglycoside product typically contains a distribution of varying concentration of saccharide units or degree of polymerization.

APGs are fatty ether derivatives of saccharides or polysaccharides. In this invention, the saccharide or polysaccharide groups are mono-, di-, tri-, etc. saccharides of hexose or pentose, and the alkyl group is a fatty group with 6 to 20 carbon atoms. Alkylpolyglycoside can be compared with the general formula of $$G_x—O—R \qquad \text{I}$$

where G is a moiety derived from a reducing saccharide contain 5 or 6 carbon atoms, i.e. pentose or hexose; and R is saturated or nonsaturated fatty alkyl group containing 6 to 20 carbon atoms; x, the degree of polymerization (D.P.) of the polyglycoside, representing the number of monosaccharide repeating units in the polyglycoside, is an integer on the basis of individual molecules, but may be an noninteger when taken on an average basis when used as an ingredients for lubricants. In this invention, preferably x has the value of less than 2.5, and more preferable is within the range between 1 and 2.

The reducing saccharide moiety, G can be derived from pentose or hexose. Exemplary saccharides are glucose, fructose, mannose, galactose, talose, gulose, allose, altrose, idose, arabinose, xylose, lyxose and ribose. Because of the ready availability of glucose, glucose is a preferred embodiment in the making of polyglycosides.

The fatty alkyl group preferably is a saturated alkyl group, although unsaturated alkyl fatty group may be used. It is also possible to use an aromatic group such as alkylphenyl, alkylbenzyl and the like in place of the fatty alkyl group to make an aromatic polyglycoside.

FIG. 1 depicts the molecular structure of a typical alkylglycoside wherein the saccharide is glucose. x can be between 1 and 10, n can be between 6 to 20. If x is larger than 1, the compound is an alkylpolyglycoside.

Figure 2:
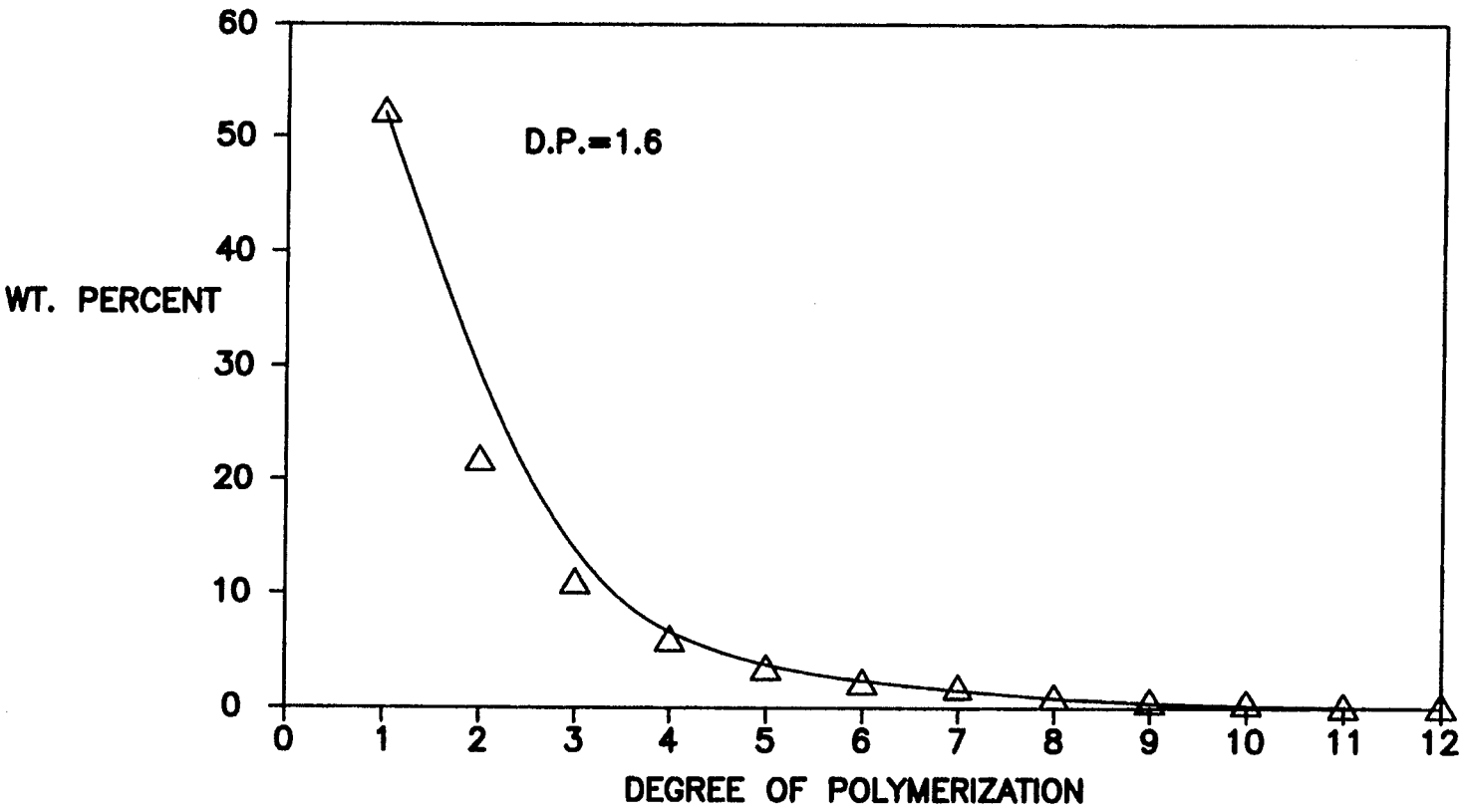
FIG. 2 shows a graph of the concentration of the various alkylpolyglycosides in a typical condensation reaction as a weight percentage versus the degree of polymerization.

FIG. 2 shows a plot of the concentration as a weight percentage versus the degree of polymerization in a typical condensation reaction. The area under the curve is the average degree of polymerization of alkylpolyglycoside mixture. The water solubility of the alkylpolyglycoside mixture increases as the average degree of polymerization increases, due to the increased presence of hydroxyl groups. Generally, commercially available polyglycosides have alkyl chains of $C_8$ to $C_{16}$ and average degree of polymerization of 1.4 to 1.6. In this invention the alkylpolyglycosides will be identified in the following way: e.g., $C_{12-16}$ G1.4 denotes an alkyl chain of 12 to 16 carbon atoms and an average degree of polymerization of 1.4 anhydroglucose units in the alkylpolyglycoside molecule. Typically, a belt lubricant concentrate of the present invention contains about 1 wt-% to about 20 wt-%, and preferably about 3 wt-% to 10 wt-% of alkylpolyglycoside. When the concentrate is diluted for use, it is preferable that the alkylpolyglycoside be present in the dilute lubricating solution in a concentration of about 10 ppm to about 2,000 ppm.

Other active ingredients may be used to improve the effectiveness of the lubricant. For example, the lubricant concentrate may also contain a fatty acid. A fatty acid is a carboxylic acid with a chain of alkyl groups, generally of $C_4$ to $C_{22}$. Fatty acids can be saturated or unsaturated. However, the fatty acids that demonstrates effective lubricating property have 10 to 22 carbons in the alkyl chain. Representatives of the preferred fatty acids for lubrication are coconut oil fatty acids and oleic acid. Coconut oil fatty acids generally is a mixture of $C_6$ to $C_{18}$, but mostly $C_{10}$ to $C_{14}$ fatty acids. Obviously, a mixture of various fatty acids can be used as ingredients for a lubricant. When fatty acids are incorporated into the lubricant concentrate, they are generally present in the range of about 2% to about 50% by weight.

Many surfactants are most effective in the neutral pH range. Moreover, acid conditions might lead to chemical attack on the some thermoplastics. It is preferable that the fatty acid be neutralized to a more neutral pH. Though a lubricant concentrate can be formulated with pH in a wide alkaline or acidic range, it is preferable that the range be between 5 and 10, and more preferably between 6 and 9. The neutralization of the fatty acids would also aid in the solubilization of the fatty acids in water. The commonly used neutralizing agents are the alkaline metal hydroxides such as potassium hydroxide and sodium hydroxide. Another class of neutralizing agent is the alkyl amines, which may be primary, secondary, or tertiary.

While many alkyl amines can be used for neutralizing the fatty acids, the preferable ones are fatty alkyl substituted amines wherein the first substitute group of the amine is a saturated or unsaturated, branched or linear alkyl group having between 8 to 22 carbon atoms, and the second substitute group of the amine is a hydrogen, alkyl group or hydroxyalkyl group having 1 to 4 carbons, or an alkoxylate group, and the third substitute group of the amine is an alkylene group of 2 to 12 carbons bonded to a hydrophilic moiety such as $—NH_2$, —OH, $—SO_3$, amine alkoxylate, alkoxylate, and the like. These amine can be compared with the formula:

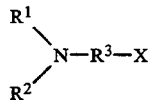

III wherein $R_1$ is an alkyl group having between 8 to 22 carbon atoms, and $R_2$ is a hydrogen, alkyl group or hydroxyalkyl group having 1 to 4 carbons or an alkoxylate group, or an alkoxylate group, $R_3$ is an alkylene group having from 2 to 12 carbon atoms, and X is a hydrogen or a hydrophilic group such as $—NH_2$, —OH, $—SO_3$, amine alkoxylate, amine alkoxylate, alkoxylate, and the like.

Examples of amines useful for neutralization are: dimethyl decyl amine, dimethyl octyl amine, octyl amine, nonyl amine, decyl amine, ethyl octyl amine, and the like, and mixtures thereof.

When X is $—NH_2$, preferable examples are alkyl propylene amines such as N-coco-1,3,diaminopropane, N-tallow-1,3,diaminopropane and the like, or mixtures thereof.

Examples of preferable ethoxylated amines are ethoxylated tallow amine, ethoxylated coconut amine, ethoxylated alkyl propylene amines, and the like, and mixtures thereof.

The amine neutralizing agent can be use alone or in conjunction with other neutralizing agents such as sodium or potassium hydroxide. Generally, when added into the lubricant concentrate, the neutralizing agent is present in the range of about 0.5% to about 30% by weight.

The fatty acids and neutralizing agents are available from commercial sources such as Akzo and Hoechst, Sherex, Henkel, Ethyl Corp.

In a lubricant concentrate, stabilizing agents, or coupling agents can be employed to keep the concentrate homogeneous under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as ethylene glycol, propylene glycol and the like. Typically, such stabilizing agents are present in the lubricant concentrate at a concentration of between about 1 wt-% to about 25 wt-%.

Dispersing agents may also be added. Examples of suitable dispersing agents include triethanolamine, alkoxylated fatty alkyl monoamines and diamines such as coco bis (2-hydroxyethyl)amine, polyoxyethylene(5-)coco amine, polyoxyethylene(15)coco amine, tallow bis(-2 hydroxyethyl)amine, polyoxyethylene(15)amine, polyoxyethylene(5)oleyl amine and the like.

Although lubricants can be manufactured and sold in dilute form, they are preferably sold as concentrates because of the ease of handling and shipping cost. A lubricant concentrate may be substantially solid, having less than about 1 wt-% of a carrier fluid for carrying the various ingredients of the lubricant. It is, however, preferable that the lubricant concentrate has a carrier fluid. The carrier fluid aids in the dispensing and dilution of the concentrate in water before application on the conveyor belt and thermoplastic containers.

Water is the most commonly used carrier for carrying the various ingredients in the formulation of the lubricant concentrate. It is possible, however, to use a water-miscible solvent, such as alcohols and polyols. These solvents may be used alone or with water. Example of suitable alcohols are ethanol, propanol, butanol. Examples of polyols are glycerol, ethylene glycol, propylene glycol, diethylene glycol, and the like, as well as mixtures thereof. Generally, when added into the lubricant concentrate, the carrier is present in the range of about 2% to about 96% by weight. When the lubricant is diluted in water for applying to a belt, water may be present in the diluted lubricating solution in the range of about 90% to 99.99 wt-%.

Generally, alkylpolyglycosides are formulated in combination with other surfactants such as ionic or nonionic surfactants. Such combinations often exhibit synergy in reducing foaming and increasing soil removal performance. Ionic surfactants can either be cationic or anionic surfactant. For a discussion on surfactants, see, Kirk-Othmer, *Surfactants,* in Encyclopedia of Chemical Technology, 19:507–593 (2d ed. 1969), which is incorporated by reference herein.

Anionic surfactants suitable for use for this invention include carboxylates, sulfates, sulfonates, phosphates, and mixtures thereof. Preferable examples of carboxylates are fatty acid soaps and related surfactants such as those mentioned in the above. The preferred sulfonates include linear alkyl benzene sulfonates, alpha-olefin sulfonates, alkyl diphenyl oxide disulfonates, alkyl diphenyl oxide disulfonate, sodium N-methyl-N-alkyltaurate, alkyl sulfonated amides, dioctyl sodium sulfosuccinate, paraffin sulfonates and olefin sulfonates such as sodium sulfonate of oleic acid, and the like, and mixtures thereof.

The preferred sulfates are alkyl ether sulfates such as polyoxyethylene coco sulfate, alcohol sulfates such as sodium lauryl sulfate, and the like, and mixtures thereof.

The preferred phosphates are alkyl orthophosphates such as stearyl acid phosphate, alkyl polyphosphates, and alkyl ether phosphate (alkyl phosphate ester). The preferred phosphate esters have alkyl chains with 8 to 16 carbon atoms. An example is lauryl oxyethylene phosphate with 2 to 4 moles of ethylene oxide moiety. When used in the lubricant concentrate, it is preferable that an anionic surfactant be present in the range of about 2% to about 25% by weight.

Nonionic surfactants include polyalkylene oxide condensates of long chain alcohols such as alkyl phenols and aliphatic fatty alcohols. Preferable examples contains alkyl chains of $C_6$ to $C_{18}$. Typical examples are polyoxyethylene adducts of tall oil, coconut oil, lauric, stearic, oleic acid, and the like, and mixtures thereof. Other nonionic surfactant can be polyoxyalkylene condensates of fatty acid amines and amides having from about 8 to 22 carbon atoms in the fatty alkyl or acyl groups and about 10 to 40 alkyloxy units in the oxyalkylene portion. An exemplary product is the condensation product of coconut oil amines and amides with 10 to 30 moles of ethylene oxide. It is possible to form a block copolymer by condensing different alkylene oxides with the same fatty acid amine or amide. An example is a polyoxalkylene condensate of a long chain fatty acid amine with three block of oxyalkylene units wherein the first and third block is consisted of propylene oxide moiety and the second block is consisted of ethylene oxide moiety. The block copolymer may be linear or branched.

Yet another kind of nonionics are alkoxylated fatty alcohols. Typical products are the condensation products of n-decyl, n-dodecyl, n-oxtadecyl alcohols, and a mixture thereof with 3 to 50 moles of ethylene oxide. When used in the lubricant concentrate, it is preferable that a nonionic surfactant be present in the range of about 1% to about 15% by weight.

Additionally, another nonionics, alkylene oxide adducts of relatively low degree of polymerization alkylglycosides may be included in the conveyor belt lubricant. These oxyalkylated glycosides comprise a fatty ether derivative of a mono-, di-, tri-, etc. saccharide having an alkylene oxide residue. Preferable examples contains 1 to 30 units of an alkylene oxide, typically ethylene oxide, 1 to 3 units of a pentose or hexose, and an alkyl group of a fatty group of 6 to 20 carbon atoms. An oxyalkylated glycoside compares with the general formula of $$H-(AO)_m-G_y-O-R$$

where AO is an alkylene oxide residue; m is the degree of alkyl oxide substitution having an average of from 1 to about 30, G is a moiety derived from a reducing saccharide contain 5 of 6 carbon atoms, i.e. pentose or hexose; R is saturated or nonsaturated fatty alkyl group containing 6 to 20 carbon atoms; and y, the degree of polymerization (D.P.) of the polyglycoside, represents the number of monosaccharide repeating units in the polyglycoside, is an integer on the basis of individual molecules, but may be an noninteger when taken on an average basis when used as an ingredients for lubricants. In this invention, preferably AO is ethylene oxide, y has the value of less than 2.7, and more preferable within the range between 1 and 2, m is from 1 to about 10 if y is 1, and preferably 1 to 30 if y is larger than 1. The reducing saccharide moiety, G, as in the case of previously mentioned alkylpolyglycoside, can be derived from pentose or hexose, preferably glucose. The fatty alkyl group, again, is preferably a saturated alkyl group, although unsaturated alkyl group, or even an aromatic group may be used.

Cationic cosurfactants suitable for use in this invention include quaternary ammonium surfactants with one or two long fatty alkyl groups and one or two lower alkyl or hydroxyalkyl substituents. Preferable examples are alkylbenzyl dimethyl ammonium chloride wherein the alkyl groups are a stearyl, tallow, lauryl, myristyl moiety, and the like, and mixtures thereof. When used in the lubricant concentrate, it is preferable that a cationic surfactant be present in the range of about 1% to about 15% by weight.

In addition to the aforementioned ingredients, it is possible to include other chemicals in the lubricant concentrates. For example, where hard water is used for the dilution of the lubricant concentrate, there is tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA). Versene is a $Na_4EDTA$ sold by Dow Chemicals. Examples of other sequestrants are: trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, and sodium salt of sodium glucoheptonate. When used in the lubricant concentrate, it is preferable that the sequestrant be present in the range of about 1% to about 15% by weight.

As previously stated, the effective cleaning and lubrication with resin compatibility is a goal of this invention. It is conceivable that other nonalkylpolyglycoside materials can be used in the formulation of the lubricant. Examples of useful lubricant materials are hydrophilic substituted aromatic hydrocarbons having an alkyl or aryl side chain. Representative of this type of stress crack inhibitors are sodium xylene sulfonate, sodium decyl diphenyl oxide, sodium dimethyl naphthalene sulfonate, sodium salts of linear alkyl benzene sulfonate, having from about $C_8$ to about $C_{12}$ in the alkyl portion and the like, as well mixtures thereof.

The lubricant concentrate is typically diluted with water before using. The range of dilution is usually between 1:100 to 1:1000. The application of the dilute aqueous lubricating composition may be by means of conventional techniques such as spraying, immersion, brushing, and the like. The dilution can be done either batchwise by adding water into a container with a suitable amount of the concentrate or continuously online. On line dilution is usually done by the regulated injection of a stream of the concentrate into a stream of water at a steady rate. The injection of the concentrate can be achieved by a pump, for example, metering pump, although other injection means are possible. Water of varying quality, for example, tap water, soft water, and deionized water may be used. The water may also be heated.

Likewise, additional ingredients may be included to improve the various properties of the lubricant concentrate. For example, ingredients may be added to improve the flowability, viscosity, stability, shelf stability against microbe attack, etc.

For a more complete understanding of the invention, examples are given to represent the embodiment. These experiments are to be understood as illustrative and not limited. All parts are by weight, except where it is contrarily indicated.

The determination of the lubricity of the lubricant concentrate is by testing the diluted aqueous lubricating composition on a 10 foot section of a continuous bottle conveyor driven by a motor which was set at 100 rpm. The diluted lubricating composition is applied on the bottles and the track by spraying through a nozzle. Typically a 1:1000 diluted solution is used although different concentration can be tested as needed. Twenty to sixty bottles are stacked in a rack on the track. The rack is connected to a stain gauge by a wire. As the belt moves, force is exerted on the strain gauge by the pulling action of the rack on the wire. The pull strength is recorded by a computer. The test is run for one hour, the pull strength and coefficient of friction from the 15 minutes to 45 minutes are averaged. The coefficient of friction is calculated on the basis of the measured force and the mass of the bottles. Different lubricants are compared by the pull strength and coefficient of friction.

The thermoplastic compatibility of the lubricating aqueous composition is determined by applying the diluted lubricating composition on a pressurized container and observing for crack patterns. Standard 2 liter thermoplastic bottles are filled with water and placed in a refrigerator over night. Then the mass of the water in each bottle is adjusted to 1800 g. A bottle is immediately capped after 30 g each of sodium bicarbonate and citric acid are added. The sodium bicarbonate and citric acid will generate $CO_2$ in the container and pressurize the bottle. One bottle is checked on the Zahn-Nagel gauge to confirm a pressure that is within a set range (4.9–5.0 volumes). The bottles are set at room temperature overnight. A lubricating solution is made by diluting the lubricant concentrate with water at 1:50 ratio. Two hundred mils of lubricating solution is foamed for 12 bottles by whipping with an electric beater for 5 minutes. The foamed lubricating solution is spread on the bottom of a plastic container. The bottles are then set in the foam. The bottles are then placed in a chamber at 100° F. with 85% relative humidity for two weeks. After two weeks, the bottles are removed from the chamber, observed for crazes, creases and crack patterns on the bottom, and compared with control bottles that have been placed in a non PET formula lubricant under similar conditions.

Table 1 shows the alkylpolyglycosides used in the examples described hereinafter. The average degree of polymerization of the APG samples varied from 1.4 to 1.7 and the alkyl groups were between $C_{8-10}$ and $C_{12-16}$.

TABLE 1

Alkylpolyglycosides (Henkel) used in the Examples.

| Alkyl Polyglycoside | APG ® Surfactant | Alkyl Chain (%) | Average DP |
|---|---|---|---|
| $C_{8-10}$ G 1.7 | 225 | 8/10 (45:55) | 1.7 |
| $C_{9-11}$ G 1.4 | 300 | 9/10/11 (20:40:40) | 1.4 |
| $C_{9-11}$ G 1.6 | 325 | 9/10/11 (20:40:40) | 1.6 |
| $C_{12-16}$ G 1.4 | 600 | 12/14/16 (68:26:6) | 1.4 |
| $C_{12-16}$ G 1.6 | 625 | 12/14/16 (68:26:6) | 1.6 |

EXAMPLE I

Lubricant Concentrate Comprising APG and Phosphate Ester

A conveyor lubricant concentrate was prepared by mixing together with stirring in a container at 45° C. the following ingredients, on a weight percent basis:

| | |
|---|---|
| Water, Distilled | 55.00 |
| Urea | 10.00 |
| Isopropyl alcohol, 99% | 10.00 |
| APG 625CS, Henkel | 8.00 |
| GAFAC BG-510, GAF (Decyl ethoxylate ethoxylate phosphate ester) | 8.00 |
| Oleic Fatty Acid | 5.00 |
| Potassium hydroxide, 45% | 4.00 |
| | 100.00 |

The lubricant was diluted with water and tested for PET compatibility with the aforementioned testing procedure. The results indicate that it is comparable to PET GUARD TM, a recognized PET compatible aqueous lubricant.

EXAMPLE II

Lubricant Concentrate Comprising APG and Phosphate Ester

A conveyor lubricant concentrate was prepared by mixing together with stirring in a container at 45° C. the following ingredients, on a weight percent basis:

| | |
|---|---|
| Water, Distilled | 45.00 |
| Urea | 10.00 |
| Isopropyl alcohol, 99% | 10.00 |
| APG 625CS, Henkel | 7.00 |
| Forlanit-P, Henkel ($C_{12}$ $(EO)_{10}$ phosphate ester) | 25.00 |
| Oleic Fatty Acid | 3.00 |
| | 100.00 |

The results indicate that this formulation was effective in reducing stress cracking.

EXAMPLE III

Comparison of Compatibility of Lubricant Concentrate Comprising APG versus Nonylphenolethoxylate Conveyor lubricant concentrates were prepared by mixing together with stirring in a container at 45° C. the following ingredients, on a weight percent basis:

| Ingredients | A | B | C |
|---|---|---|---|
| Soft Water | 38.75 | 26.00 | 29.25 |
| Hexylene Glycol | 7.50 | -0- | -0- |
| Urea | 5.00 | 15.00 | 15.00 |
| NAS (NAS-8RF) (n-Octane sulfonate) (Ecolab) | 10.00 | 20.00 | 20.00 |
| APG 625, Henkel | 8.00 | 8.00 | -0- |
| Forlanit-P, Henkel ($C_{12}$ $(EO)_{10}$ phosphate ester) | 25.00 | 25.00 | 25.00 |
| Oleic Fatty Acid | 5.00 | 5.00 | 5.00 |
| NPE 9.5 (Nonylphenolethoxylate, $(EO)_9$) (GAF) | -0- | -0- | 5.00 |
| KOH, 45% | .75 | 1.00 | .75 |
| | 100.00 | 100.00 | 100.00 |

The lubricant concentrates A, B, and C, as well as the commercial product PET GUARD TM were each diluted and tested for compatibility as previously described. PET GUARD TM is a fatty acid based lubricant concentrate which uses several amines to neutralize the fatty acids. The result shows that the ratings of compatibility with PET were, in order of decreasing compatibility: A, PET GUARD TM, B, C. This illustrates that the lubricants A, and B, which contained APG were more compatible with PET than C, which did not contain APG. Lubricant A was even better than the most PET compatible commercial Ecolab lubricant product, PET GUARD TM that is presently available. PET GUARD comprises, in an aqueous base 12% of a fatty acid, 15% higher alkyl amine ethoxylate, 20% alkyl aryl sulfonate coupling agent, 1.5% of a alkyl diamine, and 4% chelating agent.

EXAMPLE IV

Effect of Addition of APG versus Neodol to Lubricants on PET Compatibility

The aforementioned commercially available lubricant concentrate PET GUARD TM was used as a base lubricant. Conveyor lubricant concentrates were prepared by mixing together with stirring in a container at 40° C. the ingredients of the PET GUARD TM base lubricant and an additional ingredient according the following table, on a weight percent basis:

| Ingredients | Formula 1 | Formula 2 | Formula 3 |
|---|---|---|---|
| PET GUARD TM base lubricant | 95.00 | 95.00 | 95.00 |
| APG 625, Henkel | 5.00 | -0- | -0- |
| Neodol 91-6 ($C_{9-10}$ alcohol with 6 moles of ethoxylation) | -0- | 5.00 | -0- |
| Soft Water | | | 5.00 |
| | 100.0 | 100.0 | 100.00 |

The compatibility rating, from the best to the worst was: Formula 1, Formula 3, formula 2. The results indicate that when APG 625 CS was added to a base lubricant (formula 3) without the additional 5% soft water, the PET compatibility improved, whereas when a standard nonionic (Neodol 91-6) was added to the base lubricant, the PET compatibility decreased verses the base formula.

EXAMPLE V

Four conveyor lubricant concentration formulations were prepared by incorporating different APGs into a base formula material. The ingredients for the base material were mixed in a container at 45° C. The appropriate APG for a particular formula was added into the base formula material to be mixed. After the ingredients of a formula were thoroughly mixed, the lubricant concentrate was allowed to cool to room temperature. The four different lubricant concentrates were prepared this way. The base formula and the formulas for the four different lubricant concentrates are as shown in the following table.

| Base Formula | % |
|---|---|
| Soft Water | 25.0% |
| Urea | 15.0% |
| Sod. Octane Sulfonate | 20.0% |
| Forlanit-P,$C_{12}(EO)_{10}$ Phosphate Ester | 25.0% |
| Oleic Fatty Acid | 5.0% |
| KOH 45% | 2.0% |
| | 92.0% |

| Test Formulas | 1 | 2 | 3 | 4 |
|---|---|---|---|---|
| Base Formula | 92.0% | 92.0% | 92.0% | 92.0% |
| APG 625-CS | 8.0% | — | — | — |
| APG 600-CS | — | 8.0% | — | — |
| APG 325-CS | — | — | 8.0% | — |
| APG 225-CS | — | — | — | 8.0% |
| | 100.0% | 100.0% | 100.0% | 100.0% |

The four lubricant concentrates were tested for PET compatibility with the procedures previously described. PET GUARD TM was also tested as a control. The result indicates that Formula 1 and PET GUARD TM were the best, having about the same compatibility with plastics. Formula 2 was slightly better than Formula 3 which was better than Formula 4.

EXAMPLE VI

Four lubricant concentrate formulations were prepared according to the formulas of the following table by mixing the appropriate ingredients at 45° C. in a mixer. These lubricant concentrates were tested for plastic compatibility in comparison with PET GUARD TM and also with the four lubricant concentrates of the previous example, Example V. The experimental results indicate that the best thermoplastic compatibility results were achieved by Formula 1, 5, 7, as well as PET GUARD TM. Formula 8 was about as plastic compatible as Formula 3.

| Test Formulas | 5 | 6 | 7 | 8 |
|---|---|---|---|---|
| Soft Water | 25.0% | 25.0% | 45.0% | 20.0% |
| Urea | 15.0% | 15.0% | 10.0% | 15.0% |
| Sod. Octane Sulfonate | 20.0% | — | — | 20.0% |
| AlphaStep ML-40, Akyl Sulfonate (Stepan) | — | 20.0% | — | — |
| Isopropyl Alcohol | — | — | 10.0% | — |
| Steol KS-460, Alcohols Ether Sulfate (Stepan) | — | — | — | 5.0% |
| APG 625-CS | 8.0% | 8.0% | 7.0% | 8.0% |

-continued

| Test Formulas | 5 | 6 | 7 | 8 |
|---|---|---|---|---|
| Forlanit-P,$C_{12}$ $(EO)_{10}$ Phosphate Ester (Henkel) | 25.0% | 25.0% | 25.0% | 25.0% |
| Oleic Fatty Acid | 5.0% | 5.0% | 3.0% | 5.0% |
| KOH 45% | 2.0% | 2.0% | — | 2.0% |
| | 100.0% | 100.0% | 100.0% | 100.0% |

The above examples show the efficacy of APG in the reduction of stress cracking when incorporated into lubricating compositions for use in lubricating conveyor belts.

The specification, examples, data and Figures above provide a basis for understanding the present invention. However, the above disclosure is not to be interpreted as limiting the scope of the invention. Since many embodiments of the invention can be made without departing from the spirit and scope of the invention, the invention resides in the claims hereinafter appended.

What is claimed is:

1. A polyethylene and polybutylene terephthalate compatible lubricant concentrate used in the transportation of polyethylene and polybutylene terephthalate containers on a conveyor, the lubricant concentrate comprising an alkyl substituted polyglycoside (alkylpolyglycoside), said alkylpolyglycoside comprising one to three reducing saccharide units, each of which containing 5 or 6 carbon atoms, wherein the alkyl group is a saturated or nonsaturated fatty alkyl group containing 5 to 30 carbon atoms.

2. The lubricant concentrate of claim 1 wherein the reducing saccharide is glucose.

3. The lubricant concentrate of claim 1 wherein the alkyl group is a saturated fatty alkyl group containing 9 to 20 carbon atoms.

4. The lubricant concentrate of claim 1 further comprising about 2.0 wt-% to about 50.0 wt-% of a fatty acid.

5. The lubricant concentrate of claim 1 further comprising:

(a) a fatty acid;

(b) a stabilizer for facilitating the prevention of phase separation;

(c) a neutralizing agent; and (d) a carrier liquid for carrying the alkyl polyglycoside, fatty acid, stabilizer and neutralizing agent, said carrier liquid being selected from a group consisting of water, water-miscible solvent, or a mixture thereof present in the amount of 2 wt-% to 96 wt-% on the concentrate.

6. The lubricant concentrate of claim 5 wherein the neutralizing agent is a fatty alkyl substituted amine wherein the first substitute group of the amine is a saturated or unsaturated, branched or linear alkyl group having between 8 to 22 carbon atoms, and the second substitute group of the amine is a hydrogen, alkyl group or hydroxyalkyl group having 1 to 4 carbons or an alkoxylate group, and the third substitute group of the amine is an alkylene group of 2 to 12 carbons bonded to a hydrophilic moiety selected from the group consisting of $—NH_2$, —OH, $—SO_3$, amine alkoxylate, and alkoxylate.

7. The lubricant concentrate of claim 6 wherein the first substitute group of the alkyl amine has from 8 to 10 carbons and the third substitute group has a moiety of $—NH_2$.

8. The lubricant concentrate of claim 1 further comprising an anionic surfactant.

9. The lubricant concentrate of claim 1 further comprising a sequestrant.

10. The lubricant concentrate of claim 1 further comprising a nonionic surfactant.

11. The lubricant concentrate of claim 1 further comprising a nonglycoside stress crack inhibitor.

12. The lubricant concentrate of claim 4, wherein the fatty acid has between 8 to 22 carbon atoms in the alkyl group.

13. The lubricant concentrate of claim 5, wherein the lubricant concentrate has a pH value within the range between about 5 and about 9.5.

14. The lubricant concentrate of claim 5, wherein the lubricant concentrate comprises:

(a) from about 1 wt-% to about 20 wt-% of an alkyl polyglycoside;

(b) from about 2 wt-% to about 50 wt-% of a fatty acid;

(c) from about 1 wt-% to about 25 wt-% of a stabilizer for facilitating the prevention of phase separation;

(d) from about 0.5 wt-% to about 30 wt-% of a neutralizing agent; and (e) from about 2 wt-% to about 96 wt-% of a carrier liquid for carrying the alkylpolyglycoside, fatty acid, stabilizer, and neutralizing agent, said carrier liquid being selected from a group consisting of water, water-miscible solvent, or a mixture thereof.

15. A polyethylene and polybutylene terephthalate compatible aqueous lubricating composition suitable for facilitating the transportation of polyethylene and polybutylene terephthalate containers on a conveyor, the aqueous lubricating composition comprising an alkyl substituted polyglycoside (alkylpolyglycoside), said alkylpolyglycoside comprising one to three reducing saccharide units, each of which containing 5 or 6 carbon atoms, wherein the alkyl group is a saturated or nonsaturated fatty alkyl group containing 5 to 30 carbon atoms.

16. The aqueous lubricating composition of claim 15 wherein the reducing saccharide is glucose.

17. The aqueous lubricating composition of claim 15 wherein the alkyl group is a saturated fatty alkyl group containing 9 to 20 carbon atoms.

18. The aqueous lubricating composition of claim 15 further comprising between about 2 to about 50 wt-% of a fatty acid.

19. The aqueous lubricating composition of claim 15 further comprising:

(a) a fatty acid;

(b) a stabilizer for facilitating the prevention of phase separation;

(c) a neutralizing agent; and (d) a carrier liquid for carrying the alkyl polyglycoside, fatty acid, stabilizer and neutralizing agent, said carrier liquid being selected from a group consisting of water, and a mixture of water with a water-miscible solvent.

20. The aqueous lubricating composition of claim 19 wherein the neutralizing agent is a fatty alkyl substituted amine wherein the first substitute group of the amine is a saturated or unsaturated, branched or linear alkyl group having between 8 to 22 carbon atoms, and the second substitute group of the amine is a hydrogen, alkyl group or hydroxyalkyl group having 1 to 4 carbons or an alkoxylate group, and the third substitute group of the amine is an alkylene group of 2 to 12 carbons bonded to a hydrophilic moiety selected from the group consisting of $—NH_2$, —OH, $—SO_3$, amine alkoxylate, and alkoxylate.

21. The aqueous lubricating composition of claim 20 wherein the first substitute group of the alkyl amine has from 8 to 10 carbons and the third substitute group has a moiety of $—NH_2$.

22. The aqueous lubricating composition of claim 19, wherein the aqueous lubricating composition comprises:

(a) from about 10 ppm to about 2,000 ppm of an alkylpolyglycoside;

(b) from about 20 ppm to about 5,000 ppm of a fatty acid;

(c) from about 10 ppm to about 2,500 ppm of a stabilizer for facilitating the prevention of phase separation;

(d) from about 5 ppm to about 3,000 ppm of a neutralizing agent; and (e) from about 90 wt-% to about 99.99 wt-% of a carrier liquid for carrying the alkyl polyglycoside, fatty acid, stabilizer and neutralizing agent, said carrier liquid being selected from a group consisting of water, and a mixture of water with a water-miscible solvent.

23. A method for lubricating a continuously moving conveyor system for transporting a container, comprising the step of applying a polyethylene and polybutylene terephthalate compatible aqueous lubricating composition to the exterior surface of the container, the aqueous lubricating composition comprising an alkyl substituted polyglycoside (alkylpolyglycoside) which comprises one to three reducing saccharide units, each of which containing 5 or 6 carbon atoms, wherein the alkyl group is a saturated or unsaturated fatty alkyl group containing 5 to 30 carbon atoms.

24. The method of claim 23 wherein the reducing saccharide is glucose.

25. The method of claim 23 wherein the alkyl group is a saturated fatty alkyl group containing 9 to 20 carbon atoms.

26. The method of claim 23 wherein said composition further comprises about 20 to about 5,000 ppm of a fatty acid.

27. The method of claim 23 wherein said composition further comprises:

(a) a fatty acid;

(b) a stabilizer for facilitating the prevention of phase separation;

(c) a neutralizing agent; and (d) a carrier liquid for carrying the alkyl polyglycoside, fatty acid, stabilizer and neutralizing agent, said carrier liquid being selected from a group consisting of water, water-miscible solvent, or a mixture thereof.

28. The method of claim 27, wherein the neutralizing agent is a fatty alkyl substituted amine wherein the first substitute group of the amine is a saturated or unsaturated, branched or linear alkyl group having between 8 to 22 carbon atoms, and the second substitute group of the amine is a hydrogen, alkyl group or hydroxyalkyl group having 1 to 4 carbons, or an alkoxylate group, and the third substitute group of the amine is an alkylene group of 2 to 12 carbons bonded to a hydrophilic moiety selected from the group consisting of $—NH_2$, —OH, $—SO_3$, amine alkoxylate and alkoxylate.

29. The method of claim 23, wherein the aqueous lubricating composition has a pH value within the range between 5 and 10.

30. The method of claim 23, wherein the aqueous lubricating composition comprises:

(a) from about 10 ppm to about 2,000 ppm of an alkylpolyglycoside;

(b) from about 20 ppm to about 5,000 ppm of a fatty acid;

(c) from about 10 ppm to about 2,500 ppm of a stabilizer for facilitating the prevention of phase separation;

(d) from about 5 ppm to about 3,000 ppm of a neutralizing agent; and (e) from about 90 wt-% to about 99.99 wt-% of water.

* * * * *

UNITED STATES PATENT AND TRADEMARK OFFICE

CERTIFICATE OF CORRECTION

PATENT NO. : 5,352,376

DATED : October 4, 1994

INVENTOR(S) : Timothy A. Gutzmann

It is certified that error appears in the above-identified patent and that said Letters Patent is hereby corrected as shown below:

On column 2, lines 24 and 25, please delete "polyglycoside" and substitute therefore --polyglycosides--

On column 2, line 40, please delete "on" and substitute therefore --of--

On column 3, line 30, please delete "property" and substitute therefore --properties--

On column 3, line 49, please delete "contain" and substitute therefore --containing--

On column 4, line 31, please delete "contain" and substitute therefore --containing--

On column 7, line 31, please delete "contain" and substitute therefore --containing--

On column 11, line 6, please delete "contain" and substitute therefore --containing--

On column 4, line 31, please delete "of" and substitute therefore --or--

On column 11, line 6, please delete "of" and substitute therefore --or--

On column 4, line 51, please delete "an" and substitute therefore --a--

UNITED STATES PATENT AND TRADEMARK OFFICE

CERTIFICATE OF CORRECTION

PATENT NO. : 5,352,376

DATED : October 4, 1994

INVENTOR(S) : Timothy A. Gutzmann

It is certified that error appears in the above-identified patent and that said Letters Patent is hereby corrected as shown below:

On column 5, line 30, please delete "reason" and substitute therefore --reasons--

On column 8, line 29, please delete "the" after the word "on"

On column 9, line 13, please delete "use" and substitute therefore --used--

On column 9, line 54, please delete "Example" and substitute therefore --Examples--

On column 10, line 44, please delete "polyoxalkylene" and substitute therefore --polyoxyalkylene--

On column 12, line 40, please delete "stain" and substitute therefore --strain--

On column 14, line 39, please insert --TM-- after the word "Pet Guard"

On column 14, line 67, please delete "formula 2" and substitute therefore --Formula 2--

On column 15, line 1, please delete "(formula 3)" and substitute therefore --(Formula 3)--

UNITED STATES PATENT AND TRADEMARK OFFICE

CERTIFICATE OF CORRECTION

PATENT NO. : 5,352,376

DATED : October 4, 1994

INVENTOR(S) : Timothy A. Gutzmann

It is certified that error appears in the above-indentified patent and that said Letters Patent is hereby corrected as shown below:

On column 15, line 63, please delete "Akyl" and substitute therefore--Alkyl--

Signed and Sealed this

Fourteenth Day of February, 1995

*Attest:*

Bruce Lehman

BRUCE LEHMAN

*Attesting Officer*

*Commissioner of Patents and Trademarks*